United States Patent [19]

Racenis et al.

[11] Patent Number: 4,787,121

[45] Date of Patent: Nov. 29, 1988

[54] HINGE WITH STOP

[75] Inventors: Karlis V. Racenis, Wauwatosa; Donald A. Coates, Green Lake, both of Wis.

[73] Assignee: Speed Queen Company, Ripon, Wis.

[21] Appl. No.: 109,149

[22] Filed: Oct. 16, 1987

[51] Int. Cl.[4] ..... E05D 1/04

[52] U.S. Cl. ..... 16/356; 16/DIG. 13; 16/DIG. 29; 68/3 R

[58] Field of Search ..... 16/225, 355, 356, DIG. 13, 16/DIG. 29; 68/3 R, 2 D

[56] References Cited

U.S. PATENT DOCUMENTS

| | | | |
|---|---|---|---|
| 2,680,534 | 6/1954 | Penfold | 16/355 |
| 3,718,943 | 3/1973 | Bustin | 16/355 |
| 3,952,369 | 4/1976 | Erickson | 16/171 |
| 4,123,822 | 11/1978 | Bentley | 16/128 R |
| 4,302,866 | 12/1981 | Irvin | 16/171 |
| 4,315,345 | 2/1982 | Schijf | 16/DIG. 29 |

FOREIGN PATENT DOCUMENTS

| | | | |
|---|---|---|---|
| 443930 | 3/1936 | United Kingdom | 16/355 |

*Primary Examiner*—Richard K. Seidel

*Attorney, Agent, or Firm*—William R. Clark; Richard M. Sharkansky

[57] ABSTRACT

An appliance hinge having internal stop mechanisms. The hinge has a first member which provides a thin bearing surface on both sides of a formed cylindrical segment on the back lip of the door. The second hinge member is a molded block which mounts on the floor of the door recess on the appliance cabinet top, and has a cylindrical shaped guide slot for receiving the first member in sliding engagement. The first and second hinge members are snapped together to prevent disengagement during assembly. When the door is rotated about the hinge axis, the bearing surfaces of the cylindrical segment slilde along the guide slot until the door contacts the back lip of the slot and the edge of the cylindrical segment contacts the terminating surface of the guide slot. Cooperatively, these two stop mechanisms distribute the strain of a relatively strong opening force.

11 Claims, 3 Drawing Sheets

HINGE WITH STOP

BACKGROUND OF THE INVENTION

The field of the invention generally relates to hinges, and more particularly relates to hinges with stops.

An appliance such as a top loading washer typically has a door or lid that closes down into a recess so that the cabinet top will be flat when the door is closed. In one prior art hinging approach, the door has a plastic pin extending laterally from both sides at the rear. These pins, which are rigidly connected to the under side of the door, extend through respective apertures in the side walls of the recess. Accordingly, the door is opened by lifting at the front and the rear pins define the hinge axis about which the door rotates. In an alternate embodiment, the pins are connected to the cabinet top and extend laterally in from the recess walls where they are received in apertures in the door. In either case, it is a drawback not to have a stop which prevents rotation of the door past a predetermined angular orientation. For example, it is desirable to have the door rotate past the vertical orientation so that it will remain open, but it is undesirable that it rotate until it contacts the control console. If it does contact the control console, the door can inadvertently cause activation or deactivation of certain operating functions. Also, contacting the control console may cause damage to the door or the control console. Further, if the door contacts the rear wall of the recess before it engages the control console, porcelain may chip off the door or the rear wall of the recess where they engage each other.

A prior art approach for providing a positive door stop uses a wire pin hinge that extends from the door into holes in the side walls of the recess, and has an arm bent at a right angle in a downward direction. When the door is closed, the arm extends downwardly at an angle which is preferably greater than 90° rotation from the forward direction. As the door is rotated upwardly, the pins rotate about their lateral axis and the arm, which is at a right angle thereto, rotates upwardly until it engages the under side of the cabinet top. The stop is thus provided at an angular orientation before the door contacts the control console or the rear wall of the recess. This approach has the advantage of providing a stop mechanism which is not visible to the user. More specifically, when the door is closed, there is no stop protruding upwardly from the door, cabinet top, or console. However, this approach has significant drawbacks. First, strain is localized such that contact of the arm on the under side of the cabinet top may cause the cabinet top or the arm to bend if a relatively strong force is applied. Bending of the arm would generally require repair or replacement. Bending of the cabinet top could cause the porcelain on the upper surface of the cabinet top to crack or craze. Further, the assembly of this hinge structure is difficult and costly.

Another hinge approach described in U.S. Pat. No. 3,952,369 uses a base hinge portion secured to the bottom of the recess. The base hinge portion has spaced pivot arms which engage respective recesses in the other hinge portion which is connected to the lid. This hinge structure, however, does not have a positive stop, and relies on the contact of the door with the rear wall of the recess to stop rotation of the door. Accordingly, it is also subject to chipping porcelain off the door or the rear wall of the recess.

SUMMARY OF THE INVENTION

It is an object of the invention to provide a hinge with an improved stop.

It is also an object to provide an appliance hinge with a stop such as can be used for a top-loading clothes washer that seats down into a recess in the cabinet top. It is a further object to provide a hinge with a stop that does not have an upwardly protruding stop member that would prevent the top of the clothes washer from being flat when the door is closed.

Further, it is an object to provide an appliance hinge with a stop that distributes strain so that the lid and cabinet top are not damaged when the lid is opened with a relatively strong force. It is also an object that the stop of the hinge not cause cracking or crazing of the porcelain on the lid and that the lid not contact the console. It is a further object that the hinge be relatively easy to assemble.

These and other objects and advantages are provided by the invention which defines a hinge for pivotally connecting a first and second member about a pivot axis, comprising a first hinge portion comprising a cylindrical segment having first and second opposing surfaces and a terminating edge, the first hinge portion being connected to the first member, and a second hinge portion having a guide slot for receiving the cylindrical segment of the first hinge portion, the slot comprising a mouth portion, a throat portion having spaced opposing arcuate walls substantially conforming with respective ones of the first and second opposing surfaces of the cylindrical segment for receiving the cylindrical segment in sliding engagement, and an end portion, the second hinge portion being connected to the second member. It is preferable that a lip extend outwardly from the mouth portion of the second hinge portion, and that the first member engage the lip after a predetermined rotation of the first hinge portion with respect to the second hinge portion thereby providing a stop. Also, it is preferable that the lip be flexible such that after the lid contacts the lip, it bends until it engages a wall of the recess of the cabinet top in which the lid mounts. Further, it is preferable that the terminating edge of the cylindrical segment engage the end portion of the guide slot after a predetermined rotation of the first member with respect to the second member for providing a stop.

The invention may also be practiced by a hinge for pivotally connecting a first and second member about a pivot axis, comprising a first hinge portion comprising a cylindrical segment having a concave surface on one side and a concentric convex surface on the opposite side, the concave and convex surfaces terminating at an edge, the first hinge portion being connected to the first member, a second hinge portion having a guide channel for receiving the cylindrical segment of the first hinge portion, the channel having a mouth portion, a throat portion comprising a first arcuate surface substantially conforming to the concave surface and a second spaced arcuate surface substantially conforming to the convex surface, the throat receiving the cylindrical segment in sliding engagement, and an end portion, the second hinge portion being connected to the second member, the cylindrical segment being rotatable in sliding engagement in the throat portion in a first direction until the edge of the first hinge portion contacts the end portion of the guide channel thereby providing a stop, and the mouth portion having an outwardly extending lip that engages the first member at approximately the rotational position the edge engages the end portion.

The invention may further be practiced by a hinge for pivotally connecting the downwardly extending lip of the lid of a top-loading clothes washer within a recess in the cabinet top, comprising a first hinge portion connected to the lip of the lid, the first hinge portion having a first section on the inside of the lip defining a concave cylindrical bearing surface and a second section on the outside of the lip defining a convex cylindrical bearing surface, and a second hinge portion connected within the recess of the cabinet top, the second hinge portion having a guide slot for receiving the first hinge portion, the slot having a top entrance laterally extending thereacross and having a downwardly and forwardly extending throat with opposing spaced concentric bearing surfaces terminating at an end portion, the first hinge portion being engaged in the throat portion of the second hinge portion wherein, when the lid is opened upwardly from the front, the first hinge portion rotates about an axis at the center of the concentric bearing surfaces with the concave and convex surfaces of the first hinge portion respectively sliding along the concentric bearing surfaces until the edge of the lip of the lid contacts the terminating end portion of the throat thereby providing a hinge stop. It is preferable that the second hinge portion have an upwardly extending lip and the lid contact the second hinge portion lip at approximately the rotational orientation that the edge contacts the terminating end portion thereby distributing the strain applied to the hinge, the lid, and the cabinet top at the stop. It is also preferable that the cabinet top have at least first and second apertures within the recess and the second hinge portion have a bottom locating pin inserting through the first aperture, the second hinge portion being secured to the cabinet top by a screw inserted up through the second aperture into the second hinge portion. It is also preferable that the first hinge portion snap into the guide slot of the second hinge portion wherein a force is required to engage and disengage the first hinge portion from the second hinge portion. Further, it is preferable that the first hinge portion have blocks at the ends of the concave surface, the blocks being located at the sides of the second hinge portion for preventing the first hinge portion from sliding laterally with respect to the second hinge portion.

BRIEF DESCRIPTION OF THE DRAWINGS

The foregoing objects and advantages will be more fully understood with reference to the description of the preferred embodiment with reference to the drawings wherein.

DESCRIPTION OF THE PREFERRED EMBODIMENT

Figure 1:
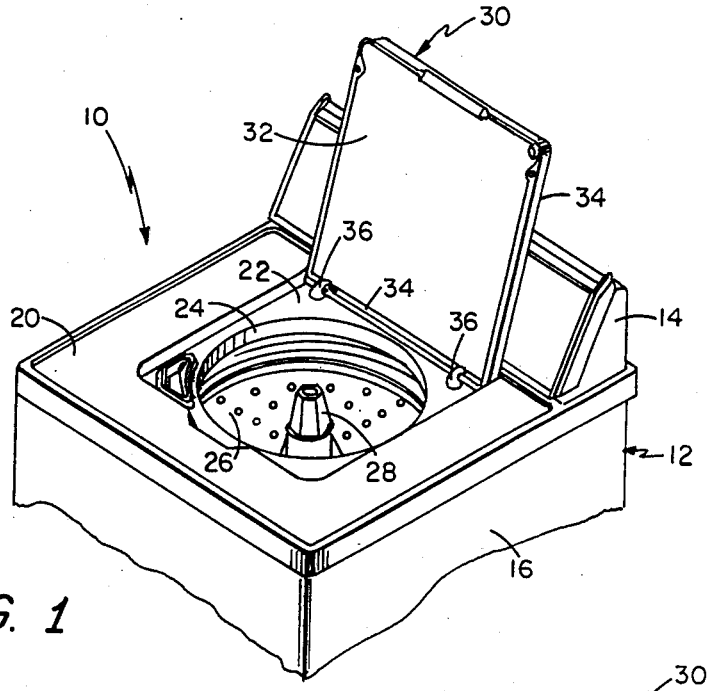
FIG. 1 is a front perspective view of a top loading washer with a stop hinge.

Referring to FIG. 1, there is shown a perspective view of top loading washer 10 which includes a cabinet 12 and control console 14. Cabinet 12 generally includes side panels 16, a front panel 18, a top panel 20 or cabinet top, and a back panel (not shown). A recess 22 is provided in top panel 20 and has an access opening 24 for loading and unloading clothes. The clothes drum 26, which includes agitator 28, is below access opening 24. The internal components of washer 10 are not shown as they are conventional and form no part of the invention. Door 30 or lid, here shown in the open position, covers access opening 24 in the closed position. Door 30 is positioned within recess 22 in the closed position so that the cabinet top is substantially flat. Door 30 includes a flat top panel 32 and peripheral sides 34 or lips. In accordance with the invention, hinges 36 are used to pivotally rotate door about an axis thereby defined. Although hinges 36 are here shown being used on a top loading washer 10, they can also be used to advantage in other appliances and other applications.

Figure 2:
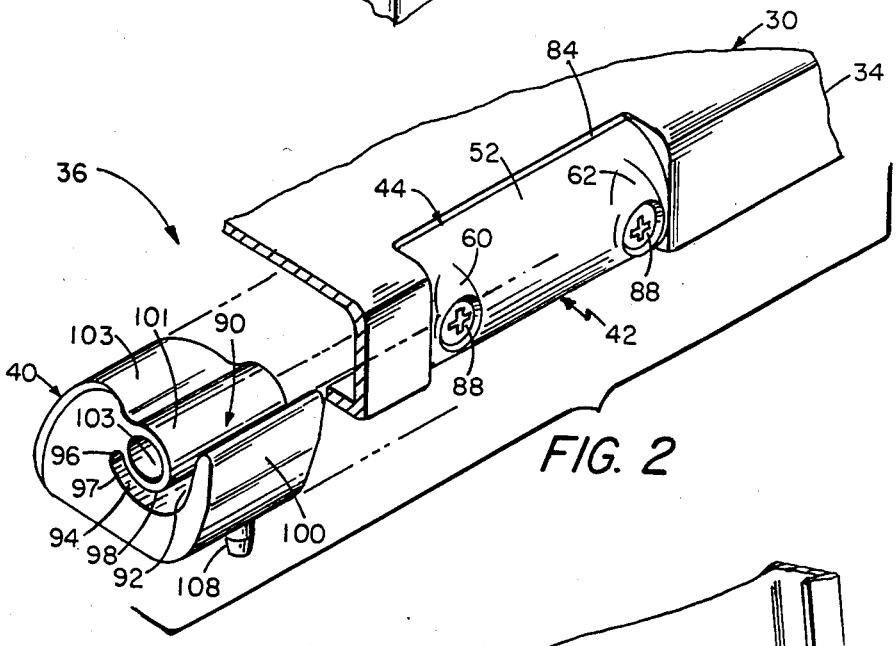
FIG. 2 is an exploded view of the hinge base and lid hinge portion.

Referring to FIG. 2, hinge 36 includes a base hinge member 40 and lid hinge member 42. Preferably, both hinge members 40 and 42 are molded plastic parts that are hard so as to resist wear, and also provide a quiet bearing surface. In one embodiment, a 20 percent talc filled polypropylene is used. Also, nylon has been found to have favorable properties for hinge 36.

Figure 4:
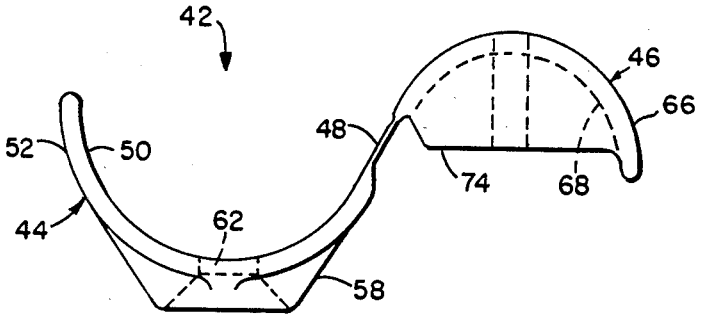
FIG. 4 is a side view of the lid hinge portion.
Figure 5:
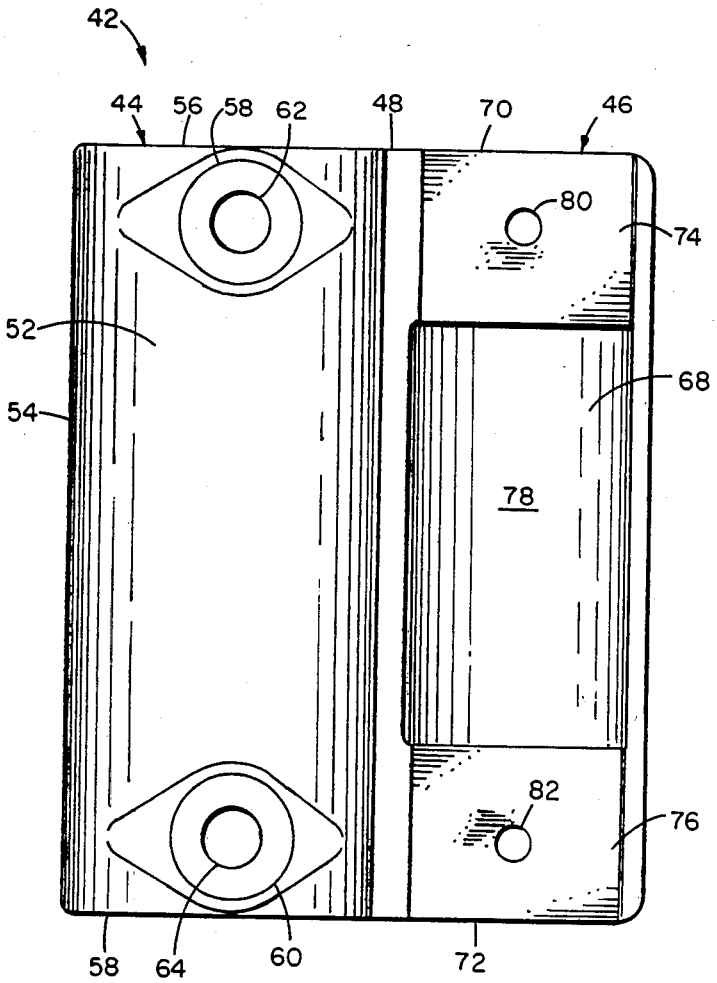
FIG. 5 is a top view of the lid hinge portion.

Referring to FIGS. 4 and 5, there are shown respective side and top views of lid hinge member 42. Lid hinge member 42 has two parallel elongated sections 44 and 46 interconnected by a living hinge 48. Section 44 has a concave surface 50 and an opposing parallel convex surface 52. Adjacent to opposite ends 56 and 58 of convex surface 52 are respective mounds 58 and 60 with central holes 62 and 64. The portion of elongated section 44 between mounds 58 and 60 defines a portion of a thin cylindrical segment 54.

Elongated section 46 has a convex surface 66 on one side and a concave surface 68 on the opposing side. At the ends 70 and 72 of concave surface 68 are respective blocks 74 and 76 which fill the cylindrical trough 78 defined by concave surface 68. Blocks 74 and 76 have respective holes 80 and 82 bored through to convex surface 66.

The back side 34 or lip of lid 30 is shaped so as to have cylindrical segments 84 aligned with connecting hinges 36. It has been found that hinges 36 can be assembled just using cylindrical segments 84 of lid 30 without the use of lid hinge member 42 as defined herein. However, it is desirable to mount lid hinge member 42 over cylindrical segment 84 of door 30 so as to provide a bearing layer which is quiet and durable. More specifically, without lid hinge member 42 connected to cylindrical segment 84 of lid 30, there may be a tendency for the paint on the cylindrical segment 84 to wear off as a result of it being in sliding engagement with base hinge member 40 as will be described in detail later herein.

Figure 3:
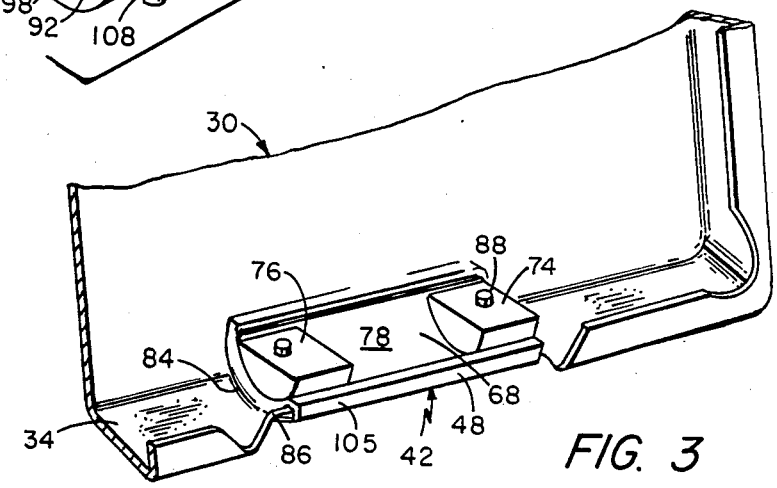
FIG. 3 is a view of the under side of the lid hinge portion.

In mounting lid hinge member 42 to door 30, living hinge 48 is positioned along the bottom 86 of cylindrical segment 84 with elongated section 44 on the outside, and then the living hinge 48 is bent so that the concave surface 50 seats against the outside of cylindrical segment 84 and the convex surface 66 of elongated section 46 seats along the inside of cylindrical segment 84. Next, screws 88 or other suitable fasteners are inserted through holes 62 and 64 and are secured to respective holes 80 and 82 on the opposite side of cylindrical segment 84. There are two corresponding holes (not shown) in cylindrical segment 84 through which screws 88 are inserted. FIGS. 2 and 3 show respective back and inside views of back side 34 of lid 30 with lid hinge member 42 mounted to cylindrical segment 84. The function of lid hinge member 42 is t provide a protective bearing layer on both sides of cylindrical segment 84 of lid 30. In other words, the composite structure is still a cylindrical segment after lid hinge member 42 is mounted, but the structure has greater thickness because lid hinge member 42 provides a bearing surface on each side of cylindrical segment 84. Also, blocks 74 and 76 provide a function to be described later herein.

Referring again to FIG. 2, base hinge member 40 is a molded plastic block having a guide slot 90 or guide channel for receiving the cylindrical segment 84 of the back side 34 of door 30, with or without the bearing layers of lid hinge member 42 being added. Guide slot 90 has a mouth 92, a throat 94, and a terminating surface 96. Mouth 92 is defined by an inner cylindrical surface 98 and a spaced lip 100. The spacing from the entrance of mouth 92 gradually decreases from the entrance downwardly to throat 94 at which point the spaced lip 100 becomes a cylindrical surface 97 parallel to and concentric with the cylindrical surface 98. See FIG. 6. The center 102 of cylindrical surface 98, which is also the center of cylindrical surface 97 of spaced lip 100 in the throat 94, defines the pivot axis of hinge 36.

Figure 6:
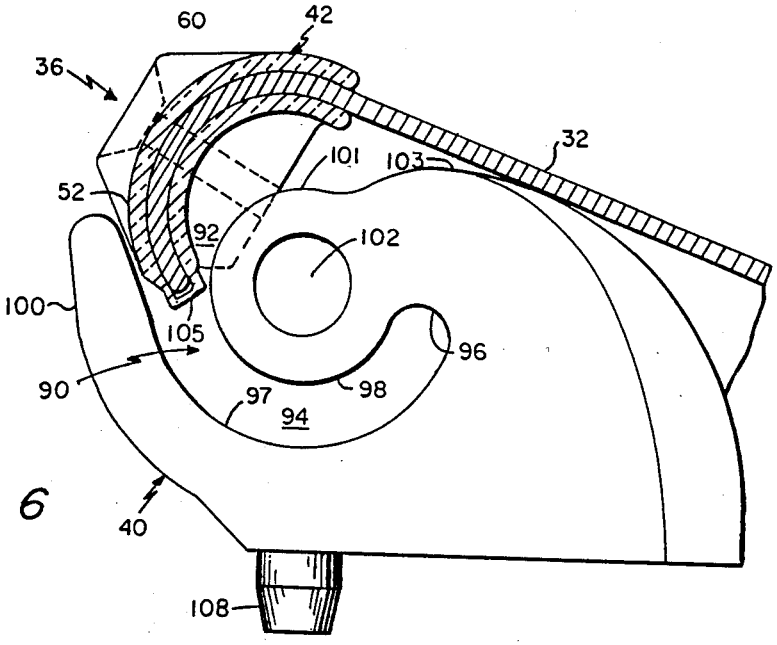
FIG. 6 is a side view of the initial gate engagement of the hinge base and lid hinge portion assembly.

Referring to FIG. 6, there is a side view of the first stage in assembling base hinge member 40 to lid hinge member 42. The top 103 of base hinge member 40 extends upwardly from neck 101 to a point such that when lid hinge member 42 is inserted into mouth 92 of base hinge member 40, top panel 32 contacts top 103 thereby preventing lid hinge member 42 from freely rotating to an orientation where it would readily slide into throat 94. More specifically, as shown in FIG. 6, the edge 105 at living hinge 48 contacts cylindrical surface 98, surface 52 contacts lip 100, and the under side of top panel 32 contacts top 103. Accordingly, to engage lid hinge member 42 which is the male portion of hinge 36 into guide slot 90 of base hinge member 40 which is the female portion, a force F must be applied. When force F is applied, lip 100 is slightly bent or deformed such that lid hinge member 42 snaps down into guide slot 90. Similarly, a force must be applied to remove lid hinge member 42 from base hinge member 40. This is important in assembling hinge 36 because, as will be described later herein, hinge 36 has to be properly aligned in recess 22; if base hinge member 40 were free to fall off or disengage from lid hinge member 42, the alignment process would be more difficult.

Figure 7:
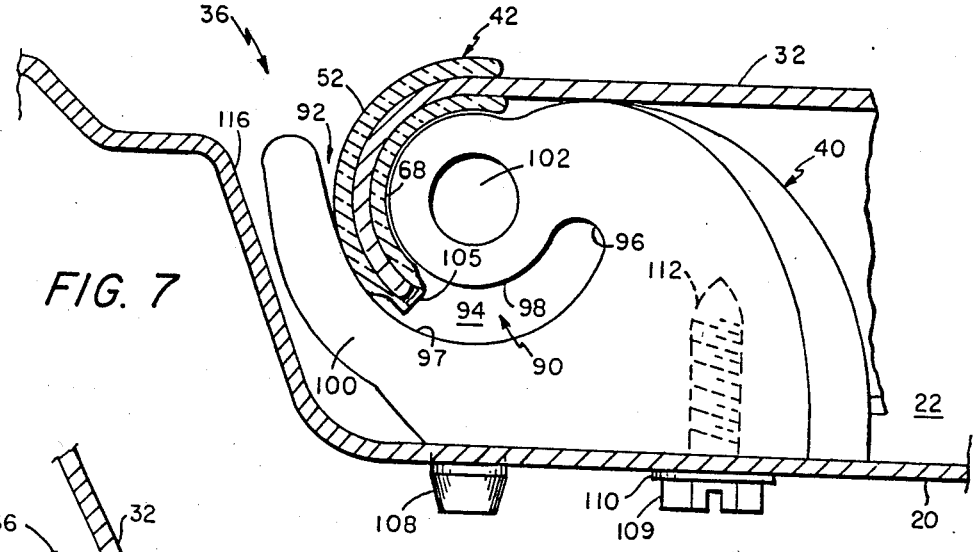
FIG. 7 is a side view of the hinge assembled.

Referring to FIG. 7, there is shown a side view of hinge 36 in the assembled configuration and mounted within recess 22. In the assembled configuration of hinge 36, concave surface 68 seats against and is in sliding engagement with cylindrical surface 98 and extends into throat 94. Surface 68 and surface 98 are substantially conforming cylindrical surfaces. Also, a portion of convex surface 52 between mounds 60 and 62 is seated against and in sliding engagement with cylindrical surface 97 of lip 100, and extends into throat 94. Convex surface 52 and cylindrical surface 97 of lip 100 are substantially conforming cylindrical surfaces. The spacing tolerances between the exposed surfaces 52 and 68 of lid hinge member 42 and their substantially congruent corresponding surfaces 98 and 97 of base hinge member 40 are selected so that lip hinge member 42 can slide smoothly and freely without wobbling within throat 94.

After hinges 36 are attached near the lateral edges on the back side 34 of lid 30 as shown in FIG. 1, the rear of lid 30 is lowered into the rear of recess 22. On each side of recess 22, there are a pair of apertures 104 and 106. Locator pin 108 on each base hinge member 40 inserts through a corresponding locating aperture 104 thereby providing alignment for inserting screw 109 with plastic washer 110 through hole 106 into an internal bore 112 in base hinge member 40. Accordingly, the hinge 36 securely engages the lid 30 to the cabinet top 20 and more particularly recess 22 such that it can pivotally open about the axis of rotation defined by centers 102.

The neck 101 of base hinge member 40 engages the trough 78 of lid hinge member 42 between blocks 74 and 76. Accordingly, blocks 74 and 76 prevent lid hinge member 42 from sliding laterally with respect to base hinge members 40 which are fastened to cabinet top 20. As can be seen in FIG. 7, the rear wall 116 of recess 22 is slightly spaced from lip 100.

Figure 8:
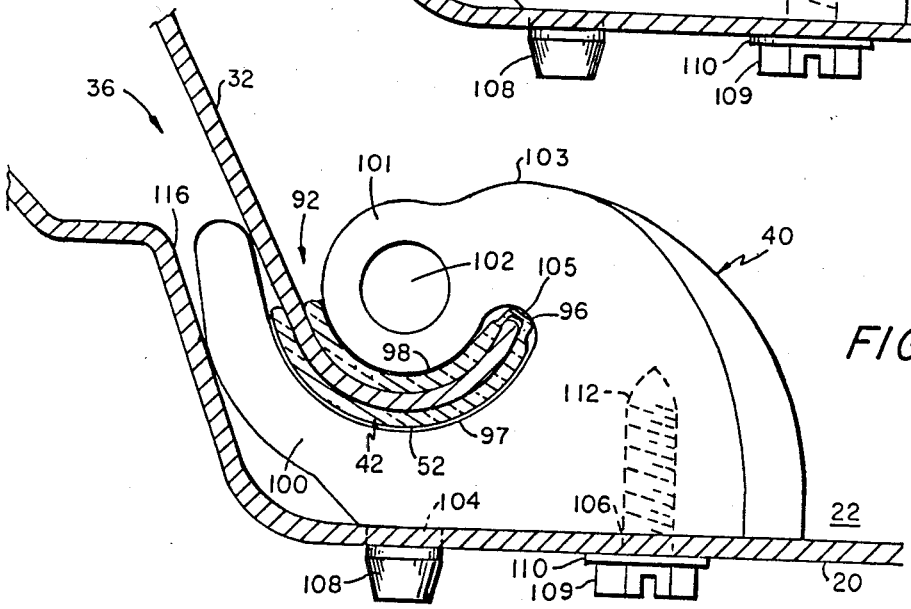
FIG. 8 is a side view of the hinge opened.

Referring to FIG. 8, hinge 36 is shown in the open orientation at the stop position. In opening lid 30 by raising the front edge, lid hinge member 42 rotates within the guide slot 90 in sliding engagement with base hinge member 42 such that lid 30 rotates about the axis of center 102. As the lid is opened, the bearing surfaces 52 and 68 of lid hinge member 42 move in sliding engagement against respective cylindrical surfaces 97 and 98 through the throat 94. At some rotating orientation which is past vertical so that the lid will stay open on its own, hinge 36 approaches its final stop position. The first stop contact is made by top panel 32 engaging lip 100, and here that happens at approximately 9°, plus or minus 1°, past vertical. Lip 100 is a resilient part that has some flex or give to it. Accordingly, when top panel 32 first contacts lip 100, there is not an abrupt stop that would put strain on the lid 30. Rather, lip 100 then slightly absorbs some of the strain as it moves through the space before it contacts rear wall 116 of recess 22 as shown in FIG. 8. At this same rotational orientation, the edge 105 of lid hinge member 42 contacts the terminating surface 96 of guide slot 90. Accordingly, the strain which would be applied by a relatively strong door opening force is distributed to different locations so as to avoid damage to any one of them. More specifically, the contacting of edge 105 on lid hinge member 42 creates an upward strain on cabinet top 20 and more particularly the under side of recess 22 at screw hole 106. This strain is distributed by plastic washer 110. Also, there is strain created on the rear wall 116 when it is contacted by lip 100. It is also noted that there is no metal-to-metal contact between lid 30 and rear wall 116 that would cause chipping of the porcelain or paint.

This concludes the description of the preferred embodiment. A reading of it by those skilled in the art will bring to mind many modifications and alterations within the spirit and scope of the invention. Accordingly, it is intended that the scope of the invention be limited only by the appended claims.

What is claimed is:

1. A hinge for pivotally connecting a first and second member about a pivot axis, comprising:

a first hinge portion comprising a cylindrical segment having first and second opposing surfaces and a terminating edge, said first hinge portion being connected to said first member;

a second hinge portion having a guide slot for receiving said cylindrical segment of said first hinge portion, said slot comprising a mouth portion, a throat portion having spaced opposing arcuate walls substantially conforming with respective ones of said first and second opposing surfaces of said cylindrical segment for receiving said cylindrical segment in sliding engagement, and an end portion, said second hinge portion being connected to said second member; and a lip extending outwardly from said mouth portion, said first member engaging said lip after a predetermined rotation of said first hinge portion with respect to said second hinge portion for providing a stop.

2. The hinge recited in claim 1 wherein said lip is flexible.

3. The hinge recited in claim 2 wherein said second member has a wall portion adjacent said lip wherein, when said first member is rotated to said lip, said lip bends until it engages said wall.

4. A hinge for pivotally connecting a first and second member about a pivot axis, comprising:

a first hinge portion comprising a cylindrical segment having a concave surface on one side and a concentric convex surface of the opposite side, said concave and convex surfaces terminating at an edge, said first hinge portion being connected to said first member;

a second hinge portion having a guide channel for receiving said cylindrical segment of said first hinge portion, said channel having a mouth portion, a throat portion comprising a first arcuate surface substantially conforming to said concave surface and a second spaced arcuate surface substantially conforming to said convex surface, said throat receiving said cylindrical segment in sliding engagement, and an end portion, said second hinge portion being connected to said second member;

said cylindrical segment being rotatable in sliding engagement in said throat portion in a first direction until said edge of said first hinge portion contacts said end portion of said guide channel thereby providing a stop; and said mouth portion having an outwardly extending lip that engages said first member at approximately the rotational position said edge engages said end portion.

5. The hinge recited in claim 4 wherein said lip is flexible.

6. The hinge recited in claim 4 wherein said first member comprises a wall portion adjacent said lip.

7. In a top loading clothes washer, a hinge for pivotally connecting the downwardly extending lip of the lid of said washer within a recess in the cabinet top, comprising:

a first hinge portion connected to said lip of said lid, said first hinge portion having a first section on the inside of said lip defining a concave cylindrical bearing surface and a second section on the outside of said lip defining a convex cylindrical bearing surface; and a second hinge portion connected within said recess of said cabinet top, said hinge portion having a guide slot for receiving said first hinge portion, said slot having a top entrance extending laterally thereacross and having a downwardly and forwardly extending throat with opposing spaced concentric bearing surfaces terminating at an end portion, said first hinge portion being engaged in said throat portion of said second hinge portion wherein, when said lid is opened upwardly from the front, said first hinge portion rotates about an axis at the center of said concentric bearing surfaces with said concave and convex surfaces of said first hinge portion respectively sliding along said concentric bearing surfaces until the edge of said lip of said lid contacts the terminating end portion of said throat thereby providing a hinge stop.

8. The hinge recited in claim 7 wherein said second hinge portion has an upwardly extending lip and said lid contacts said second hinge portion lip at approximately the rotational orientation that said edge contacts said terminating end portion thereby distributing the strain applied to said hinge, said lid, and said cabinet top at said stop.

9. The hinge recited in claim 7 wherein said cabinet top has at least first and second apertures within said recess and said second hinge portion has a bottom locating pin inserting through said first aperture, said second hinge portion being secured to said cabinet top by a screw inserted up through said second aperture into said second hinge portion.

10. The hinge recited in claim 7 wherein said first hinge portion snaps into said guide slot of said second hinge portion wherein a force is required to engage and disengage said first hinge portion from said second hinge portion.

11. The hinge recited in claim 7 wherein said first hinge portion has blocks at the ends of said concave surface, said blocks being located at the sides of said second hinge portion for preventing said first hinge portion from sliding laterally with respect to said second hinge portion.

* * * * *